United States Patent [19]

Shimalla et al.

[11] Patent Number: 4,774,124

[45] Date of Patent: Sep. 27, 1988

[54] PATTERN DENSIFIED FABRIC COMPRISING CONJUGATE FIBERS

[75] Inventors: Charles J. Shimalla, Kendall Park; Alfred T. Mays, East Windsor, both of N.J.

[73] Assignee: Chicopee, New Brunswick, N.J.

[21] Appl. No.: 110,021

[22] Filed: Oct. 15, 1987

Related U.S. Application Data

[63] Continuation of Ser. No. 857,911, Apr. 30, 1986, abandoned, and a continuation of Ser. No. 430,307, Sep. 30, 1982, abandoned.

[51] Int. Cl.[4] ..... B32B 5/14

[52] U.S. Cl. ..... 428/171; 156/209; 156/290; 156/308.2; 428/195; 428/218; 428/224; 428/288; 428/373; 428/296

[58] Field of Search ..... 428/195, 171, 218, 224, 428/288, 373, 296; 156/209, 290, 308.2, 311, 312

[56] References Cited

U.S. PATENT DOCUMENTS

| | | | |
|---|---|---|---|
| 3,765,997 | 10/1973 | Dunning | 428/296 |
| 4,035,219 | 7/1977 | Cumbers | 428/296 |
| 4,068,036 | 1/1978 | Stanistreet | 428/373 |
| 4,103,058 | 7/1978 | Humlicek | 428/296 |
| 4,306,929 | 12/1981 | Menikheim | 428/296 |

*Primary Examiner*—James J. Bell

[57] ABSTRACT

A nonwoven fabric comprising at least 15 percent conjugate fibers having a low melting point component and method of making the same, said fabric comprising high loft regions immediately adjacent densified regions produced by compressing the web at a temperature below the softening point of the low melting point component of the conjugate fiber and at a temperature and pressure sufficient to deform and compact the conjugate fibers and compact the fibers of the web in only the densified regions.

5 Claims, 1 Drawing Sheet

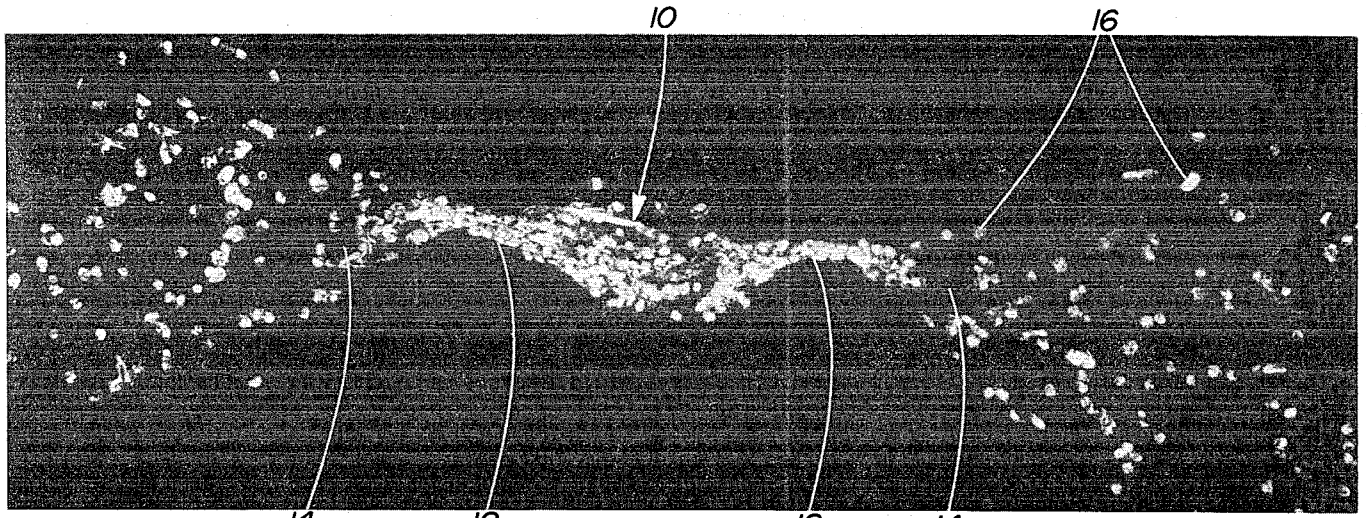
16
10
14
12
12
14

PATTERN DENSIFIED FABRIC COMPRISING CONJUGATE FIBERS

This application is a continuation of application Ser. No. 857,911, filed Apr. 30, 1986, now abandoned, and a continuation of application Ser. No. 430,307, filed Sept. 30, 1982, now abandoned.

BACKGROUND OF THE INVENTION

Methods of compression embossing fibrous webs are known in the art. Methods of heat embossing fibrous webs including fibrous webs comprising thermoplastic fibers are also known. In general, the heat embossing is done by means of heated rollers, with the fibrous web traveling through the nip between the counterrotating heated rollers. To maintain a good through-put speed, the rollers are usually heated a few degrees higher than the melting point of the thermoplastic fibers in the web or the temperature desired in the embossing process. This is necessary so that the web traveling quickly through the nip achieves the desired temperature.

Fabrics which have been heat embossed and in particular fabrics which have been heat embossed in a pattern by patterned rollers often display damage from excessive heat. In particular, in order to achieve heat sufficient to fuse the fibers in the patterned regions, the fibers immediately adjacent the patterned regions are heated to a temperature sufficient to cause shrinkage and damage. The heat radiated to the fibers next adjacent the patterned area also shrinks the web blurring the line of demarkation of the pattern. In the method of the present invention, a combination of heat and pressure is used to compact the fibers in the patterned regions in the web. This combination of factors does not effectively radiate to the fibers next adjacent the pattern region of the fabric, creating a fabric with very sharp pattern delineation and high loft adjacent the pattern region.

It is also old in the art to cold emboss to form or laminate fibrous layers. Cold embossing of moist fibrous layer produces a compacted product which exhibits deformation of fibers and hydrogen bonding. Paper toweling is often made by such a method. The compaction achieved with cold embossing can be undone with water. In the method and fabric of the present invention, the compaction of the fibrous web may not be reversed or undone by the application of water.

SUMMARY OF THE INVENTION

The present invention comprises a method of pattern embossing a nonwoven web of fibers comprising conjugate fibers and the fabric formed thereby. The method comprises heat embossing the web at a temperature slightly below the softening point of the low melting point component of the conjugate fiber, and with the combination of pressure and temperature sufficient to cause cold flow of at least the low melting point component of the conjugate fibers to deform and compact the conjugate fibers compacting the fibers of the web in only the patterned regions. The fabric formed according to the method has a very sharp pattern delineation and high loft immediately adjacent the pattern. The web contains at least 15 percent conjugate fibers. In a preferred embodiment, the conjugate fibers are a sheath/core of high density polyethylene/polyester fibers.

DESCRIPTION OF THE DRAWING

The FIGURE is a photomacrograph showing a cross-section of a fabric prepared according to the method of the present invention.

DETAILED DESCRIPTION OF THE INVENTION

The present invention comprises a method of embossing a web comprising at least 15 percent conjugate fibers and the fabric formed thereby. The conjugate fibers comprise a low melting point component and a high melting point component, and preferably comprise a sheath/core polyethylene/polyester fiber.

Preferably, the conjugate fibers employ high density polyethylene, that is, linear polyethylene that has a density of at least about 0.94, and a Melt Index ("M.I.") by ASTM D-1238(E) (190° C., 2160 gms.) of greater than 1, preferably greater than about 10, and more preferably from about 20 to about 50. Usually the fibers will be composed of about 40 to 60 weight percent, and preferably 45 to 55 weight percent, polyester, the remainder being polyethylene.

The fabrics of the invention are produced by first forming a fibrous web comprising a loose array of the conjugate fibers, as by carding, air laying, or the like. The exact weight of the fibrous web has not been found to be narrowly critical, although useful weights have been found within the range from about 0.2 to about 4.2 ounces per square yard. This web is then conveyed to the nip of the embossing rollers.

According to the method of the present invention, a combination of heat and pressure is applied at the embossing nip combined to cause the low melting point component of the conjugate fibers of the web to cold flow. The method of the present invention encompasses using patterned embossed rolls generally known in the art. The pattern embossed rollers have raised patterned surface areas which contact and compress the web as it passes through the nip of a pair of counterrotating pattern emboss rollers. In the conventional heat embossing operation, the rollers are heated to a temperature many degrees above the effective temperature needed at the nip. This is necessary to maintain a good through-put speed of the web. The elevated temperature assures that during the short amount of time that the web spends in the nip, the effective temperature within the web is reached.

In the method of the present invention, the rollers are heated to a temperature below the softening point of the low melting point component of the conjugate fiber of the web which is to be processed through the nip of the rollers. As the web passes through the nip, the combination of heat and pressure applied by the patterned embossed rollers causing at least the low melting point component of the conjugate fibers of the web to cold flow and deform and compact the conjugate fibers, compacting the fibers in the web, in only the patterned regions. By using a combination of pressure and temperature, the method of the present invention avoids fiber shrinkage and web damage in the regions immediately adjacent the patterned regions normally caused by the radiation of heat from the super heated rollers used when heat alone is used to fuse the fibers of the web.

The fibrous webs used in practicing the method according to the present invention comprise at least 15 percent conjugate fibers and preferably sheet/core high density polyethylene/polyester conjugate fibers. Examples of other conjugate fibers which may be used in the method of the present invention are copolyester/-polyester and nylon 6/nylon 66 fibers. Optionally, before passing to the nip, the web may be heated with heated air at a temperature sufficient to fuse the conjugate fibers to each other and to other fibers in the web to strengthen the fabric in the remaining, unpatterned regions.

The FIGURE illustrates a microscopic cross-section of a fabric formed according to the present invention. The fabric shown generally at 10 has embossed densified regions 12 created by the deforming and compacting of the conjugate fiber, compacting all the fibers in the web in only the pattern embossed region. The deformation and compaction of the conjugate fibers are accomplished by a combination of heat and pressure. In the method of the present invention, the heated embossed rollers are heated to a temperature slightly below the softening point of the low melting point component of the conjugate fibers. Sufficient pressure is applied in the patterned area to permanently deform the low melting point component of the conjugate fiber and hence the conjugate fiber. Any other fibers in the patterned regions of the web are compacted and the web is maintained in a densified state by the deformation of the conjugate fibers. The patterned regions display an opacity that is believed due to the air fiber interfaces. One could speculate that the deformation of the conjugate fibers is caused by cold flow of at least the sheath and perhaps the core of the fibers. In the regions 14 immediately adjacent the densified patterned regions, the fabric shows a very high loft and individual fibers 16 are seen. The high loft delineates the pattern of the fabric and indicates a lack of fiber damage in the regions immediately adjacent the patterned regions.

We claim:

1. A method of making a nonwoven fabric having high-loft regions sharply delineated from immediately adjacent densified patterned regions, said method comprising: forming a web of a loose array of fibers, at least 15 percent of said fibers being conjugate fibers having a low melting point component and a high melting point component; conveying said web to a nip between a pair of embossing rollers having raised patterned surface areas; heating said rollers to a temperature slightly below the softening point of the low melting point component of the conjugate fibers; passing said web through said nip so that only the raised patterned surface areas apply pressure to the fibers in said web as it passes through the nip between the embossing rollers; controlling the combination of temperature and pressure as said web is passed through the nip to compact the fibers in the areas of the raised patterned surface area and to cause at least the low melting point component of the conjugate fibers to cold flow and densify said web in regions corresponding to said raised patterned surface areas, while maintaining immediately adjacent regions of said web as high-loft regions; and maintaining the densified regions of said web by permanent deformation of the conjugate fibers in the patterned regions, so as to maintain the fibers in only the patterned regions in a densified state.

2. A nonwoven fabric having high-loft regions sharply delineated from immediately adjacent densified patterned regions made in accordance with the method as set forth in claim 1.

3. The method as defined in claim 1 wherein the conjugate fibers have a polyethylene sheath and a polyester core.

4. A nonwoven fabric of claim 2 wherein the conjugate fibers have a polyethylene sheath and a polyester core.

5. The method as defined in claim 1, further including the step of heating said web with heated air at a temperature sufficient to fuse the conjugate fibers to each other and to other fibers prior to conveying said web through said nip.

* * * * *